US008180237B2

(12) United States Patent
Sasaki et al.

(10) Patent No.: US 8,180,237 B2
(45) **Date of Patent: *May 15, 2012**

(54) IMAGE FORMING APPARATUS, DEVELOPING METHOD, AND IMAGE FORMING METHOD

(75) Inventors: Tsutomu Sasaki, Matsumoto (JP); Kazuhiro Nishiyama, Shiojiri (JP); Akihiro Gomi, Fujimi-machi (JP)

(73) Assignee: Seiko Epson Corporation, Tokyo (JP)

( * ) Notice: Subject to any disclaimer, the term of this patent is extended or adjusted under 35 U.S.C. 154(b) by 433 days.

This patent is subject to a terminal disclaimer.

(21) Appl. No.: 12/408,948

(22) Filed: Mar. 23, 2009

(65) Prior Publication Data

US 2010/0080595 A1 Apr. 1, 2010

(30) Foreign Application Priority Data

Mar. 26, 2008 (JP) ..... 2008-080317
Dec. 17, 2008 (JP) ..... 2008-320711

(51) Int. Cl.
*G03G 15/10* (2006.01)
*G03G 21/00* (2006.01)

(52) U.S. Cl. ..... 399/57; 399/237; 399/240; 399/256

(58) Field of Classification Search ..... 399/45, 399/57, 233, 237, 239, 240, 254, 255, 256
See application file for complete search history.

(56) References Cited

U.S. PATENT DOCUMENTS 6,219,501 B1 * 4/2001 Zhao et al. ..... 399/57
6,542,704 B2 4/2003 Suetsugu
6,580,879 B2 6/2003 Coleman et al.
6,640,073 B2 10/2003 Kurotori et al.
6,735,408 B2 * 5/2004 Yoshino et al. ..... 399/237
6,819,888 B2 * 11/2004 Teraoka et al. ..... 399/57
6,987,941 B2 1/2006 Takeuchi et al.
7,676,167 B2 * 3/2010 Yoshioka et al. ..... 399/53
7,764,887 B2 * 7/2010 Kasai ..... 399/27
7,792,440 B2 * 9/2010 Takano et al. ..... 399/45
7,885,565 B2 * 2/2011 Sasaki et al. ..... 399/57
2003/0231903 A1 12/2003 Kim
2004/0253021 A1 12/2004 Park
2005/0053398 A1 3/2005 Kim et al.

(Continued)

FOREIGN PATENT DOCUMENTS

JP 07175311 A * 7/1995

(Continued)

OTHER PUBLICATIONS

U.S. office action dated Jul. 28, 2010 for related U.S. Appl. No. 12/405,673.

*Primary Examiner* — David Gray
*Assistant Examiner* — Fred L Braun
(74) *Attorney, Agent, or Firm* — DLA Piper LLP (US)

(57) ABSTRACT

An image forming apparatus and method charges and exposes a latent image carrier to form a latent image. Bias is applied to liquid developer on a developer carrier, and liquid developer collected by a developer carrier cleaning member is stored in a collected developer storing portion. The state of the collected liquid developer is determined based on a state of bias application or detected image data, and a stirring amount of a conveying member that stirs the collected liquid developer is controlled based on the determined state to improve a property of the collected liquid developer conveyed to a storing unit.

15 Claims, 14 Drawing Sheets

U.S. PATENT DOCUMENTS

| | | | |
|---|---|---|---|
| 2009/0023089 | A1 | 1/2009 | Teshima et al. |
| 2009/0123167 | A1 | 5/2009 | Tanaka |
| 2009/0196657 | A1 | 8/2009 | Okumura et al. |

FOREIGN PATENT DOCUMENTS

| | | | | |
|---|---|---|---|---|
| JP | 2001-125383 | | | 5/2001 |
| JP | 2001324900 | A | * | 11/2001 |
| JP | 2004012652 | A | * | 1/2004 |
| JP | 2006072076 | A | * | 3/2006 |
| JP | 2006113197 | A | * | 4/2006 |
| JP | 2006268034 | A | * | 10/2006 |
| JP | 2007206288 | A | * | 8/2007 |

* cited by examiner

IMAGE FORMING APPARATUS, DEVELOPING METHOD, AND IMAGE FORMING METHOD

BACKGROUND

1. Technical Field

The present invention relates to an image forming apparatus using a liquid developer including carrier liquid and toner, a developing method, and an image forming method.

2. Related Art

In the related art, some of wet-type image forming apparatuses configured to develop an electrostatic latent image formed on an image carrier by a liquid developer thin layer formed by a developing device, and transfer a visualized image onto a printing medium have a structure including a developing unit having a developer carrier for feeding the liquid developer thin layer to the image carrier disposed thereon, a developer carrier cleaning unit that removes and collects the liquid developer on the developer carrier after development, and a liquid developer storage which is able to store the liquid developer in the developing unit.

The developing unit includes a developer collecting unit that collects the undeveloped liquid developer removed from the developer carrier and conveys to the liquid developer storage (JP-A-2001-125383).

However, with the technology disclosed in JP-A-2001-125383, when conveying the collected liquid developer to the liquid developer storage, the developer retains in the developer collecting unit, so that the stirring property and the dispersing property of developer after development and new developer might be lowered. Also, the stirring property and the dispersing property of the liquid developer to be conveyed to the liquid developer storage might be lowered depending on the state of the collected liquid developer. Consequently, the wide density fluctuations in the liquid developer storage may be resulted.

SUMMARY

An advantage of some aspects of the invention is to provide an image forming apparatus, a developing method, and an image developing method which provide improved stirring property and dispersing property of liquid developer in a developer container without adding a new member or changing the configuration significantly, and provide a good image quality at low cost.

An image forming apparatus includes a latent image carrier on which a latent image is formed; a charging unit that charges the latent image carrier; an exposing unit that exposes the latent image carrier charged by the charging unit and forms the latent image; a developing unit having a developer carrier that carries liquid developer including toner and carrier liquid, a developer feeding member that feeds the liquid developer to the developer carrier, a bias applying member that applies a bias to the liquid developer on the developer carrier, a developer carrier cleaning member that collects the liquid developer on the developer carrier, a collected developer storing portion that stores the liquid developer collected by the developer carrier cleaning member, a feeding unit that feeds the liquid developer to the collected developer storing portion and the developer feeding member, a conveying member that stirs the liquid developer collected by the collected developer storing portion, and a stirring amount adjusting member that adjusts the stirring amount of the conveying member; and a transfer member that transfers an image on the latent image carrier.

A liquid developer state determining unit that determines the state of the liquid developer stored in the collected developer storing portion is also provided.

An image data detecting unit that detects image data is also provided.

The image data detecting unit calculates an image occupancy ratio on the basis of the number of dots to be printed on one transfer material.

The image data detecting unit detects a charged state of the liquid developer carried by the developer carrier.

The image data detecting unit detects a discharge current from the bias applying member.

The liquid developer state determining unit estimates the coagulating state of toner in the liquid developer in the collected developer storing portion on the basis of the result of detection from the image data detecting unit.

The conveying member is an auger having a helical blade.

The conveying member includes a conveying section that conveys the liquid developer in a first direction, and a retaining section that retains the liquid developer or a reversely conveying section that conveys the liquid developer in a direction opposite from the first direction.

The conveying member swings in the first direction which is a direction of conveyance of the liquid developer and the direction opposite from the first direction.

The stirring amount adjusting unit changes the conveying velocity of the conveying member according to the coagulated state of the toner in the liquid developer estimated by the liquid developer state determining unit.

The stirring amount adjusting unit changes the revolving direction of the conveying member according to the coagulated state of the toner in the liquid developer estimated by the liquid developer state determining unit.

A developing method according to an aspect of the invention includes: detecting the state of bias application of liquid developer carried by a developer carrier; determining the state of the liquid developer in a collected developer storing portion in a developer container from the state of bias application; and controlling a stirring amount of a conveying member on the basis of the result of determination.

An image forming method according to an aspect of the invention includes: developing a latent image exposed on a latent image carrier by an exposing unit on a developer carrier; detecting image data when carrying out image formation by transferring the developed image to a transferring member; determining the state of liquid developer in a collected developer storing portion in a developer container on the basis of the result of detection from the image data; and controlling a stirring amount of a conveying member on the basis of the result of determination.

The state of the liquid developer in the collected developer storing portion is estimated corresponding to the image data.

According to the image forming apparatus in the aspect of the invention, improvement of the stirring property and the dispersing property of the liquid developer in the developer container without adding a new member or changing the configuration significantly is achieved. Also, alleviation of the load of calculation is achieved.

BRIEF DESCRIPTION OF THE DRAWINGS

The invention will be described with reference to the accompanying drawings where like numbers reference like elements.

DESCRIPTION OF EXEMPLARY EMBODIMENTS

Figure 1:
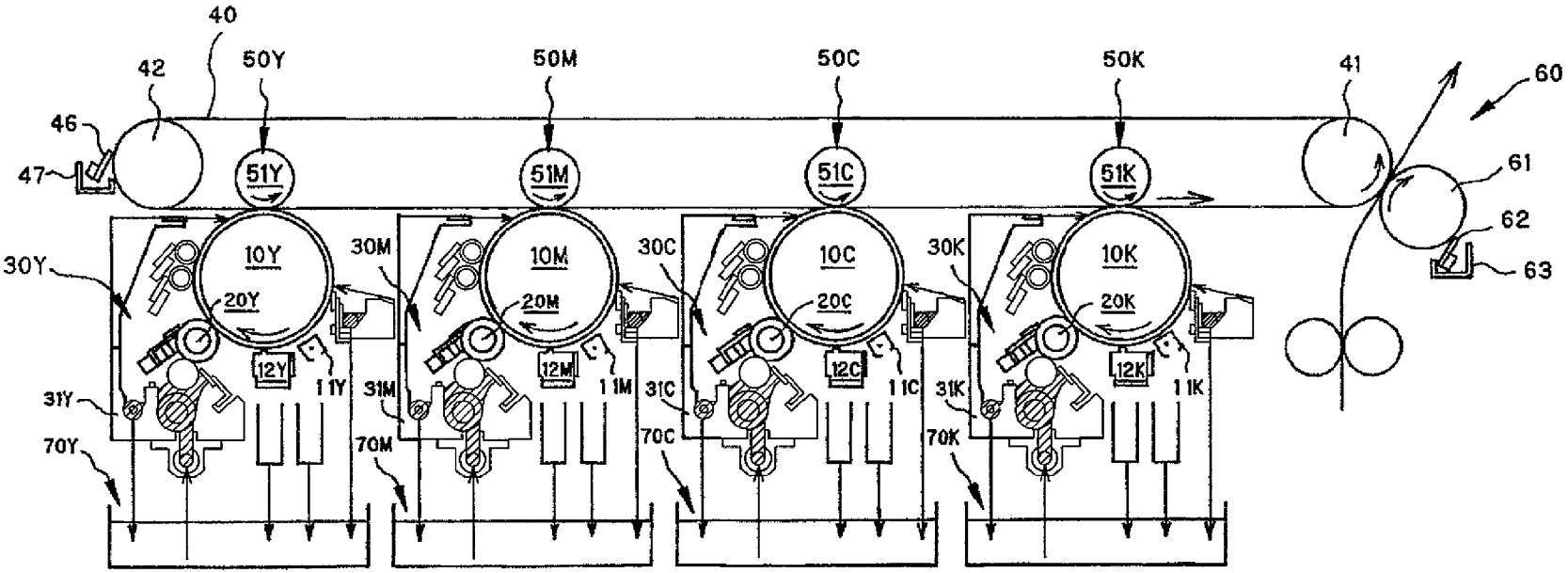
FIG. 1 is a drawing showing an embodiment of an image forming apparatus.
Figure 2:
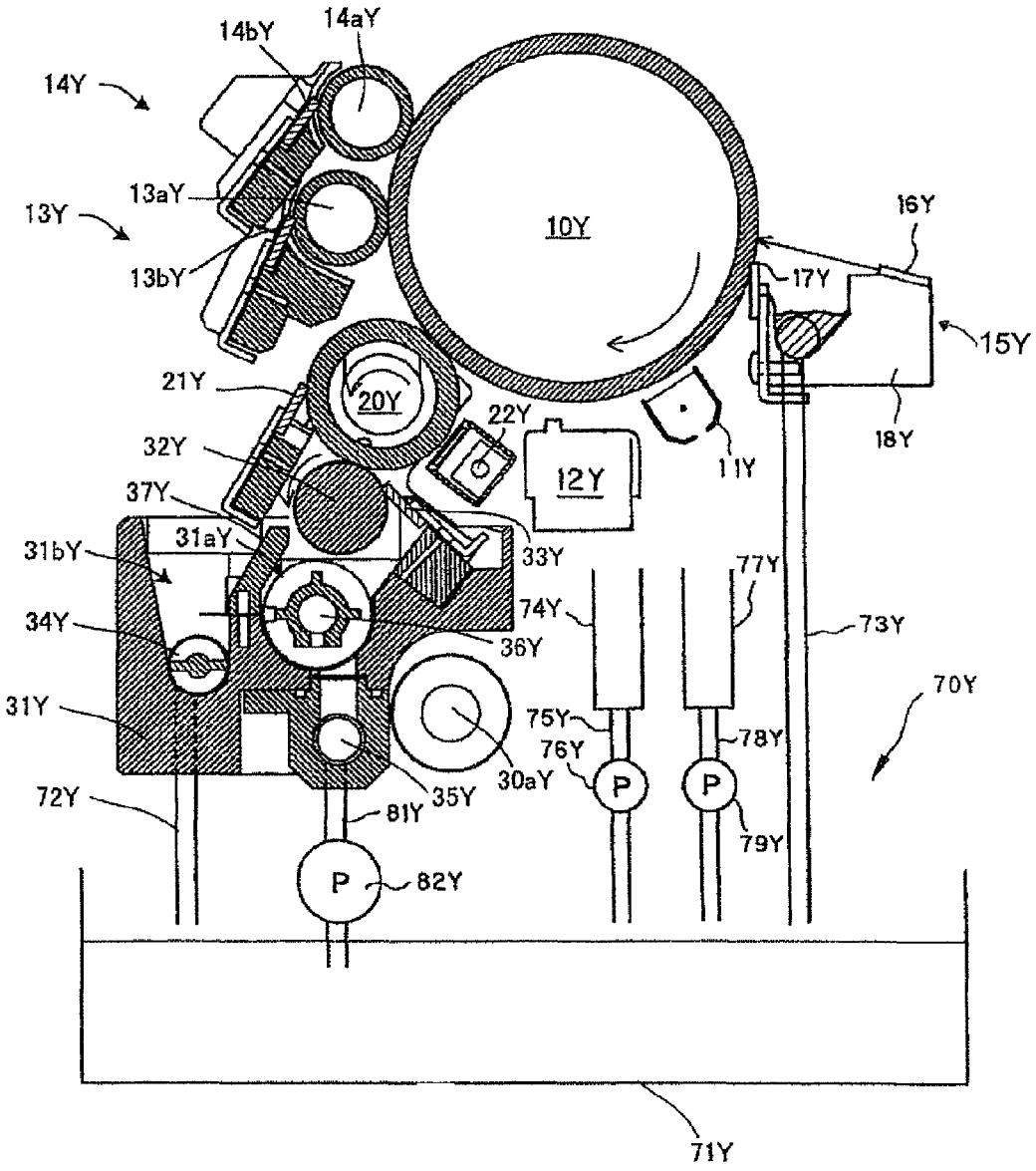
FIG. 2 is a cross-sectional view showing the periphery of a latent image carrier and principal components of a developing unit.

Referring now to drawings, embodiments of the invention will be described below. FIG. 1 is a drawing showing principle components which constitute an image forming apparatus according to an embodiment of the invention, and FIG. 2 is a cross-sectional view showing the periphery of a latent image carrier 10Y and the principal components of a developing unit 30Y as a developing device. Configurations of latent image carriers 10Y, 10M, 10C, 10K and developing unit 30Y, 30M, 30C, 30K for respective colors are the same, and hence description will be given specifically on the periphery of the latent image carrier 10Y and the developing unit 30Y for yellow (Y).

In a developer container 31Y, toner particles in liquid developer have a positive charge, and the liquid developer is stirred by a stirring auger 36Y, and then is pumped up from the developer container 31Y by the rotation of a developer feeding roller 32Y as a developer feeding member.

The developer regulating blade 33Y comes into abutment with the surface of the developer feeding roller 32Y, leaves liquid developer in grooves of depressions and projections in an anilox pattern formed on the surface of the developer feeding roller 32Y, scrapes remaining excessive liquid developer to regulate the amount of the liquid developer to be fed to a developing roller 20Y as a developer carrier. With such regulation, the film thickness of the liquid developer to be applied to the developing roller 20Y is quantified to approximately 6 μm. The liquid developer scraped by the developer regulating blade 33Y falls back into the developer container 31Y by a gravitational force, and the liquid developer which is not scraped by the regulating blade 33Y is stored in the grooves of the depressions and projections on the surface of the developer feeding roller 32Y and is applied to the surface of the developing roller 20Y by being press-contacted to the developing roller 20Y.

The developing roller 20Y applied with the liquid developer by the developer feeding roller 32Y opposes a developer compressing device 22Y downstream from a nip portion with respect to the developer feeding roller 32Y. A bias of approximately +400 V is applied on the developing roller 20Y and a bias higher than that of the developing roller 20Y and having the same polarity as the polarity of electricity charged on the toner is applied on the developer compressing device 22Y. For example, a bias of approximately +4 kv is applied on the developer compressing device 22Y.

The latent image carrier 10Y is formed of amorphous silicon. The surface of the latent image carrier 10Y is charged to approximately +600 V by a charger 11Y upstream from the nip portion with respect to the developing roller 20Y, and then a latent image is formed by an exposing unit 12Y so that the potential of an image portion becomes +25 V. In a developing nip portion formed between the developing roller 20Y and the latent image carrier 10Y, toner particles are selectively moved to an image portion on the latent image carrier 10Y in accordance with an electric field formed by a bias of +400 V applied on the developing roller 20Y and a latent image on the latent image carrier 10Y (+25 V for image portions, +600 V for non-image portions), whereby a toner image is formed on the latent image carrier 10Y. Since carrier liquid is not affected by the electric field, it is separated at an exit of the developing nip portion between the developing roller 20Y and the latent image carrier 10Y and is attached both to the developing roller 20Y and the latent image carrier 10Y. The liquid developer on the developing roller 20Y after having passed through the developing nip portion is collected by a developing roller cleaning blade 21 as a developer carrier cleaning member and cleaned away.

The latent image carrier 10Y after having passed through the developing nip portion then passes through a squeeze roller 13Y. The squeeze roller 13Y has a function to collect excessive carrier liquid and fogging toner which is originally unnecessary from the developer developed on the latent image carrier 10Y to improve the toner particle ratio in a visible image. The excessive carrier liquid collecting performance can be set to a desired collecting performance depending on the direction of rotation of a first squeeze roller 13*a*Y and a second squeeze roller 14*a*Y, and the relative peripheral velocity difference of the surfaces of the first squeeze roller 13*a*Y and the second squeeze roller 14*a*Y with respect to the peripheral velocity of the surface of the latent image carrier 10Y, and when the first squeeze roller 13*a*Y and the second squeeze roller 14*a*Y are rotated in the opposite direction from the latent image carrier 10Y, the collecting performance is enhanced, and the collecting performance is also enhanced by setting the peripheral velocity difference to a large value and, in addition, a multiplier effect can also be expected.

In this embodiment, as an example, the first squeeze roller 13*a*Y and the second squeeze roller 14*a*Y are rotated together with the latent image carrier 10Y at a substantially same peripheral velocity, the excessive carrier liquid of about 5 to 10% in weight ratio is collected from a developer D developed on the latent image carrier 10Y, so that rotational drive loads of both the rollers are alleviated and a disturbance effect of the latent image carrier 10Y to the visible toner image is restrained.

Subsequently, the latent image carrier 10Y passes through the nip portion with respect to an intermediate transfer belt 40 at a primary transfer 50Y and the primary transfer of the visible toner image to the intermediate transfer belt 40 is achieved. A voltage of approximately −200 V having an opposite polarity from the charging characteristics of the toner particles is applied on a primary transfer roller 51Y so that the toner is primarily transferred from the surface of the latent image carrier 10Y to the intermediate transfer belt 40, whereby only the carrier liquid is remained on the latent image carrier 10Y. On the downstream side from a primary transfer portion in the direction of rotation of the latent image carrier 10Y, an electrostatic latent image is erased from the latent image carrier 10Y by a static eliminating device 16Y including LED or the like after the primary transfer, and the carrier liquid remaining on the latent image carrier 10Y is scraped off by a latent image carrier cleaning blade 17Y and is collected by a developer collecting unit 18Y.

The toner image on the intermediate transfer belt 40 formed by overlapping and holding toner images formed on a plurality of the latent image carriers 10 by being primarily transferred in sequence is then advanced to a secondary transfer unit 60 and enters a nip portion between the intermediate transfer belt 40 and a secondary transfer roller 61.

However, in the case of occurrence of a sheet material feeding trouble such as a jam, the toner images are not entirely transferred to and collected by a secondary transfer roller, but partly remain on the intermediate transfer belt, and in a normal secondary transfer process, the toner images on the intermediate transfer belt is not secondary-transferred to a sheet material by 100%, but several percents of the toner image remain thereon without being secondary-transferred. In particular, when a sheet material feeding trouble such as the jam occurs, the toner images come into contact with the secondary transfer roller 61 without the intermediary of the sheet material and transferred thereto, which causes the sheet material to be stained on the back surface thereof.

For the disposal of the unnecessary toner image, in this embodiment, the carrier liquid is collected (squeezed) to the side of the secondary transfer roller 61, and a cleaning of the surface of the intermediate transfer belt 40 by an intermediate transfer belt cleaning blade 46 and a developer collecting unit 47, and a cleaning of the secondary transfer roller 61 by a secondary transfer roller cleaning blade 62 are carried out.

An image forming method in the image forming apparatus in the embodiment as described above roughly includes pumping liquid developer from a feeding unit 31*a*Y in the developer container 31Y in which the liquid developer is stored by the developer feeding roller 32Y, feeding the liquid developer to the developing roller 20Y by the developer feeding roller 32Y, charging the latent image carrier 10Y by the charger 11Y, exposing the latent image carrier 10Y by the exposing unit 12Y, applying and developing the liquid developer carried by the developing roller 20Y to the latent image carrier 10Y, transferring the image on the latent image carrier 10Y to the intermediate transfer belt 40, and cleaning the liquid developer on the developing roller 20Y by the developing roller cleaning blade 21Y.

Subsequently, the developer container 31Y and a developer collecting and refilling device 70Y in this embodiment will be described in detail.

The developer collecting and refilling device 70Y includes a liquid developer storing unit 71Y which stores the collected liquid developer, refilling high-density developer from a developer tank 74Y as a feeding unit and the carrier liquid from a carrier liquid tank 77Y as a feeding unit, respectively for adjusting the density.

The liquid developer stored in the liquid developer storing unit 71Y is not a low-density (on the order of 1 to 2 wt %), low-viscosity, and volatile liquid developer having a volatility at a room temperature and including Isopar (trademark of Exon) as carrier liquid used generally in the related art, but a high-density, high-viscosity, and non-volatile liquid developer having a non-volatility at a room temperature. In other words, the liquid developer in the invention is a highly viscous (on the order of 30 to 10000 mpa·s) liquid developer obtained by adding solid material of 1 μm in average particle diameter including a coloring agent such as pigment to thermoplastic resin into a liquid solvent such as organic solvent, silicon oil, mineral oil or edible oil together with a dispersing agent to have a toner solid content density of approximately 25%.

In this embodiment, the liquid developer is collected from the developing unit 30Y and the latent image carrier 10Y.

The developing unit 30Y has the developer container 31Y and the like for feeding and collecting the liquid developer. The developer container 31Y includes the feeding unit 31*a*Y and a collecting unit 31*b*Y, the feeding unit 31*a*Y includes the stirring auger 36Y as a stirring member for stirring the developer in the developer container 31Y, and a communicating unit 35Y for feeding the liquid developer from the liquid developer storing unit 71Y, described later, to the stirring auger 36Y, and the collecting unit 31*b*Y includes a collecting auger 34Y as a conveying member having a helical blade for transferring the liquid developer scraped by the developing roller cleaning blade 21Y, the first squeeze roller cleaning blade 13*b*Y, and the second squeeze roller cleaning blade 14*b*Y in the first direction X and feeding the same to the liquid developer storing unit 71Y.

The liquid developer collected to the side of the collecting unit 31*b*Y of the developing unit 30Y is collected in the liquid developer storing unit 71Y via a developing unit collecting channel 72Y as a collecting channel disposed on one end side of the collecting auger 34Y or as a developing device collecting channel. The liquid developer collected by a latent image carrier cleaning device 15Y including the latent image carrier cleaning blade 17Y and the developer collecting unit 18Y from the latent image carrier 10Y is collected in the liquid developer storing unit 71Y via a latent image carrier collecting channel 73Y.

Furthermore, the high-density developer is refilled in the liquid developer storing unit 71Y from the developer tank 74Y via a developer refilling channel 75Y and a developer pump 76Y. The carrier liquid is refilled in the liquid developer storing unit 71Y from the carrier liquid tank 77Y via a carrier liquid refilling channel 78Y and a carrier liquid pump 79Y. A structure of refilling by opening and closing a valve or the like using the gravitational force instead of the pump or the like is also applicable.

The liquid developer stored in the liquid developer storing unit 71Y is fed to the developer container 31Y via a developer feeding channel 81Y, a developer feeding pump 82Y, and the communicating unit 35Y.

Figure 3:
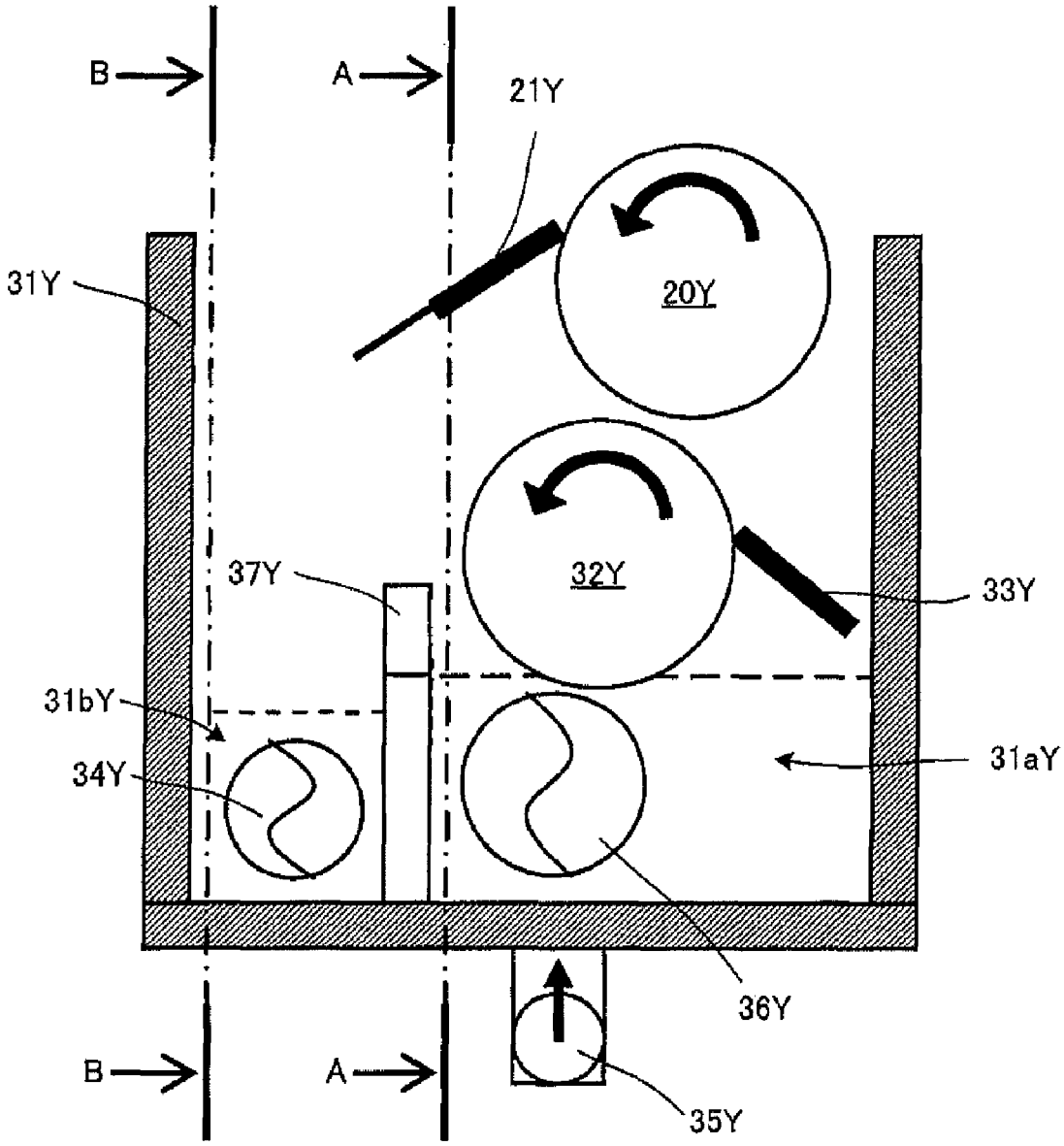
FIG. 3 is a schematic cross-sectional view showing a part of a developing unit 30Y.
Figure 4:
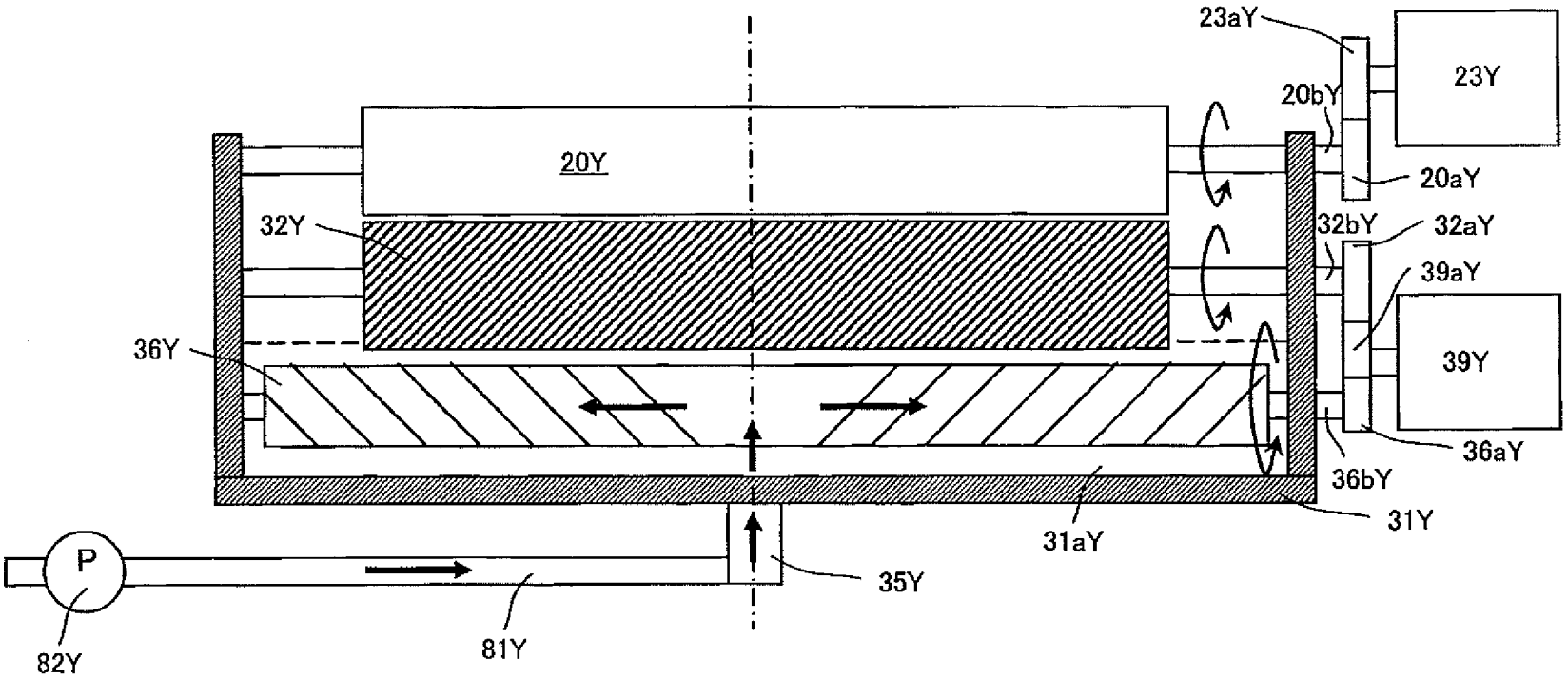
FIG. 4 is a cross-sectional view taken along a plane indicated by arrows A-A in FIG. 3.
Figure 5:
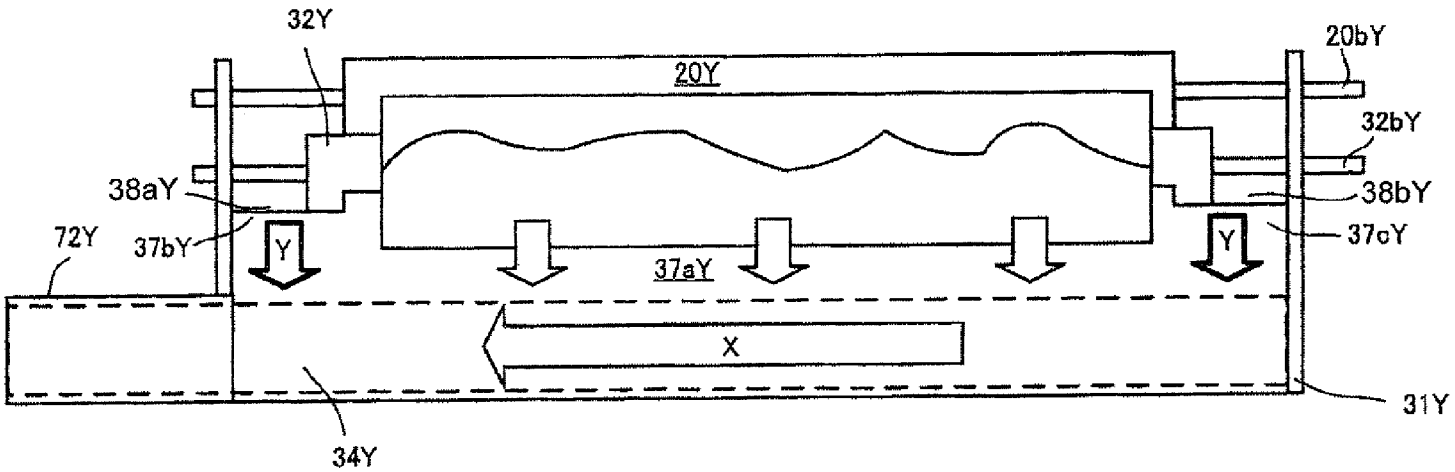
FIG. 5 is a cross-sectional view taken along a plane indicated by arrows B-B in FIG. 3.

Subsequently, the flow of the liquid developer in the developer container 31Y will be descried. FIG. 3 is a schematic cross-sectional view of the developing unit 30Y, FIG. 4 is a cross-sectional view taken along a plane indicated by arrows A-A in FIG. 3, and FIG. 5 is a cross-sectional view taken along a plane indicated by arrows B-B in FIG. 3.

The developer container 31Y in this embodiment is provided with a liquid level adjusting panel 37Y as a partitioning member between the feeding unit 31*a*Y and the collecting unit 31*b*Y. The liquid level adjusting panel 37Y is disposed in a second direction Y, which is the direction orthogonal or substantially orthogonal to a first direction X with respect to the collecting auger 34Y, and includes a first fluidizing portion 38$a$Y and a second fluidizing portion 38$b$Y for causing the liquid developer to flow from the feeding unit 31$a$Y. For example, the liquid level adjusting panel 37Y has a structure including a first wall height portion 37$a$Y having a first wall height provided on the center side of the liquid level adjusting panel 37Y and second wall height portions 37$b$Y having a second wall height lower than the center side by providing the first fluidizing portion 38$a$Y on an upper portion on the side of the developing unit collecting channel 72Y and the second fluidizing portion 38$b$Y on the side opposite from the developing unit collecting channel 72Y.

A structure in which the liquid level adjusting panel 37Y is formed to have a uniform wall height, and is formed with a hole on the developing unit collecting channel 72Y side as the first fluidizing portion 38$a$Y and a hole on the side opposite from the developing unit collecting channel 72Y as the second fluidizing portion 38$b$Y is also applicable. Combination of the structure in which the wall height on both sides is lower than that of the center side and the structure in which the holes are provided is also applicable.

The liquid developer is pumped up from the liquid developer storing unit 71Y shown in FIG. 2 by the developer feeding pump 82Y, and is fed to the feeding unit 31$a$Y in the developer container 31Y through the developer feeding channel 81Y and the communicating unit 35Y. As shown in FIG. 4, the communicating unit 35Y is provided at the substantially center portion in the axial direction, and the liquid developer fed to the feeding unit 31$a$Y is spread from the substantially center portion in the axial direction to both ends by the rotation of the stirring auger 36Y as shown by arrows.

When the amount of the liquid developer in the feeding unit 31$a$Y is increased, the liquid developer is overflowed from the first fluidizing portion 38$a$Y or the second fluidizing portion 38$b$Y provided at the end portions of the liquid level adjusting panel 37Y shown in FIG. 5 to the collecting unit 31$b$Y. In the collecting unit 31$b$Y, the liquid developer is conveyed to the developing unit collecting channel 72Y by the rotation of the collecting auger 34Y, and is collected in the liquid developer storing unit 71Y via the developing unit collecting channel 72Y.

As shown in FIG. 4, the developing roller 20Y is driven by a developing roller drive motor 23Y as a developer carrier drive source via a developing roller drive motor gear 23$a$Y together with a developing roller gear 20$a$Y and a developing roller shaft 20$b$Y. The developer feeding roller 32Y and the stirring auger 36Y are driven by a developer feeding unit motor 39Y as a common developer feeding unit drive source via the developer feeding unit motor gear 39$a$Y together with a developer feeding roller gear 32$a$Y and a developer feeding roller shaft 32$b$Y, and a stirring auger gear 36$a$Y and a stirring auger shaft 36$b$Y, respectively. The collecting auger 34Y is driven by a developer collecting unit motor 39$c$Y as the developer collecting unit drive source together with a collecting auger gear and the collecting auger shaft 39$e$Y.

The liquid developer flowed from the first fluidizing portion 38$a$Y or the second fluidizing portion 38$b$Y of the liquid level adjusting panel 37Y, the liquid developer flowed from other portion of the liquid level adjusting panel 37Y, and the liquid developer collected from the developing roller cleaning blade 21Y are stirred while being conveyed by the collecting auger 34Y. Therefore, by disposing the second fluidizing portion 38$b$Y on the upstream side opposite from the developing unit collecting channel 72Y, the distance for stirring is increased, and the stirring property is improved. Therefore, a state of being mixed easily with liquid developer having other densities when being collected in the liquid developer storing unit 71Y is achieved.

Figure 6:
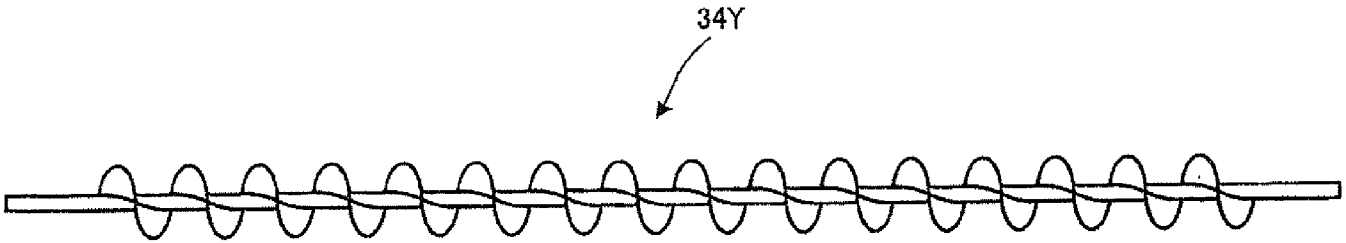
FIG. 6 is a drawing showing a collecting auger.

FIG. 6 is a drawing showing the collecting auger 34Y. The collecting auger 34Y conveys the liquid developer, and, as shown in FIG. 6 for example, includes a helical blade. With the provision of the helical blade as described above, a portion for conveying the liquid developer is formed, and hence the stirring property and the dispersing property are improved.

Figure 7:
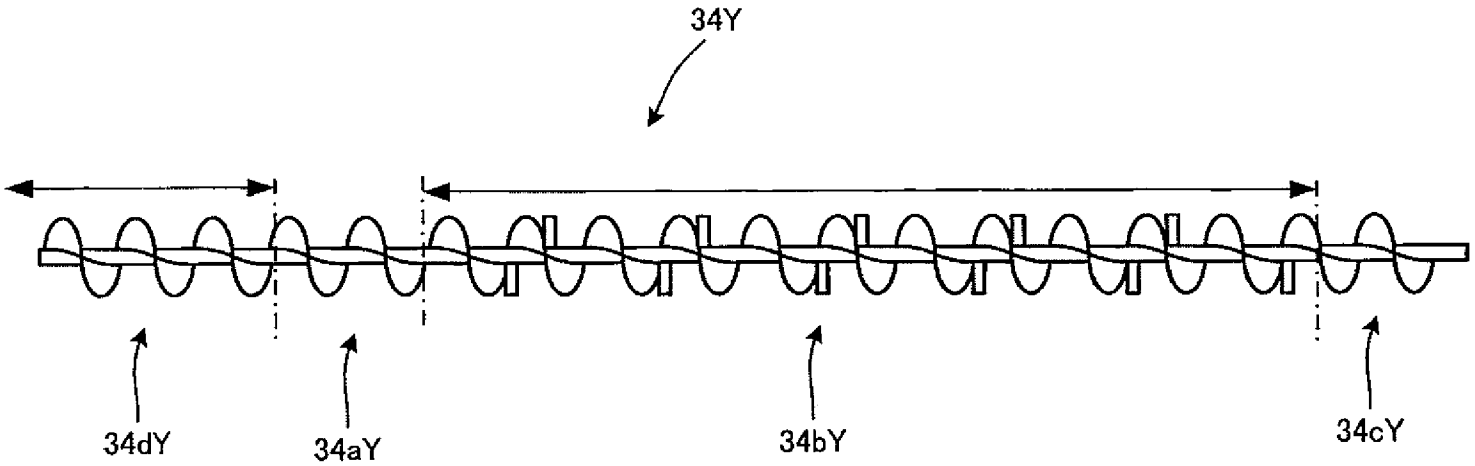
FIG. 7 is a drawing showing the collecting auger.
Figure 8:
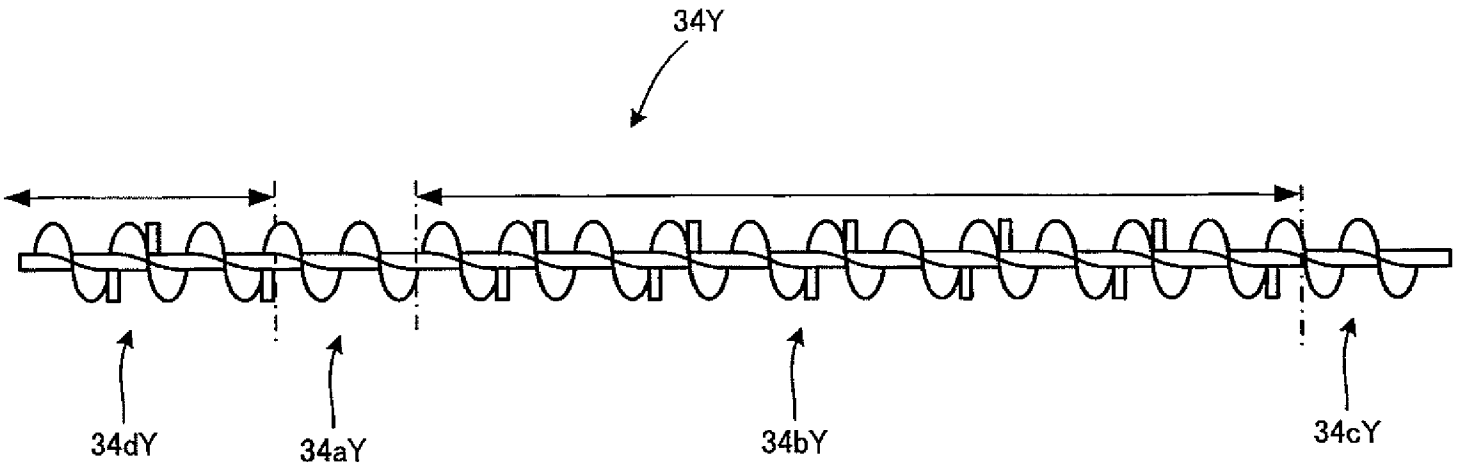
FIG. 8 is a drawing showing the collecting auger.

FIG. 7 and FIG. 8 are drawings showing the collecting auger 34Y according to other embodiments. The collecting auger 34Y includes a retaining section that retains conveyance of the liquid developer temporarily and, for example, paddles are provided at some midpoints of the helical blade as shown in FIG. 7 and FIG. 8. In this manner, with the provision of the paddles at the some midpoints of the helical blade, the retaining section for retaining conveyance of the liquid developer temporarily or a reversely conveying section that conveys the liquid developer in the reverse direction is formed, so that the stirring property and the dispersing property are improved.

The collecting auger 34Y may have a structure including, for example, a first conveying pitch section 34$a$Y as a first conveying section at a lower position corresponding to the first fluidizing portion 38$a$Y, a second conveying pitch section 34$b$Y as a second conveying section at a lower portion corresponding to the developing roller cleaning blade 21Y, a third conveying pitch section 34$c$Y as a third conveying section at lower portion corresponding to the second fluidizing portion 38$b$Y, and a fourth conveying pitch section 34$d$Y as a fourth conveying section in the sealed developing unit collecting channel 72Y.

The collecting auger 34Y shown in FIG. 7 has the paddles in the second conveying pitch section 34$b$Y, and hence a large shearing force is applied to the developer which is collected by the developing roller cleaning blade 21Y and coagulated once, so that the stirring property and the dispersing property are improved.

The collecting auger 34Y shown in FIG. 8 has the paddles in the second conveying pitch section 34$b$Y and the fourth conveying pitch section 34$d$Y, and hence a large shearing force is applied to the developer which is collected by the developing roller cleaning blade 21Y and coagulated once and a large shearing force is applied in the developing unit collecting channel 72Y having a tubular sealed structure, so that the stirring property and the dispersing property are improved.

Figure 9:
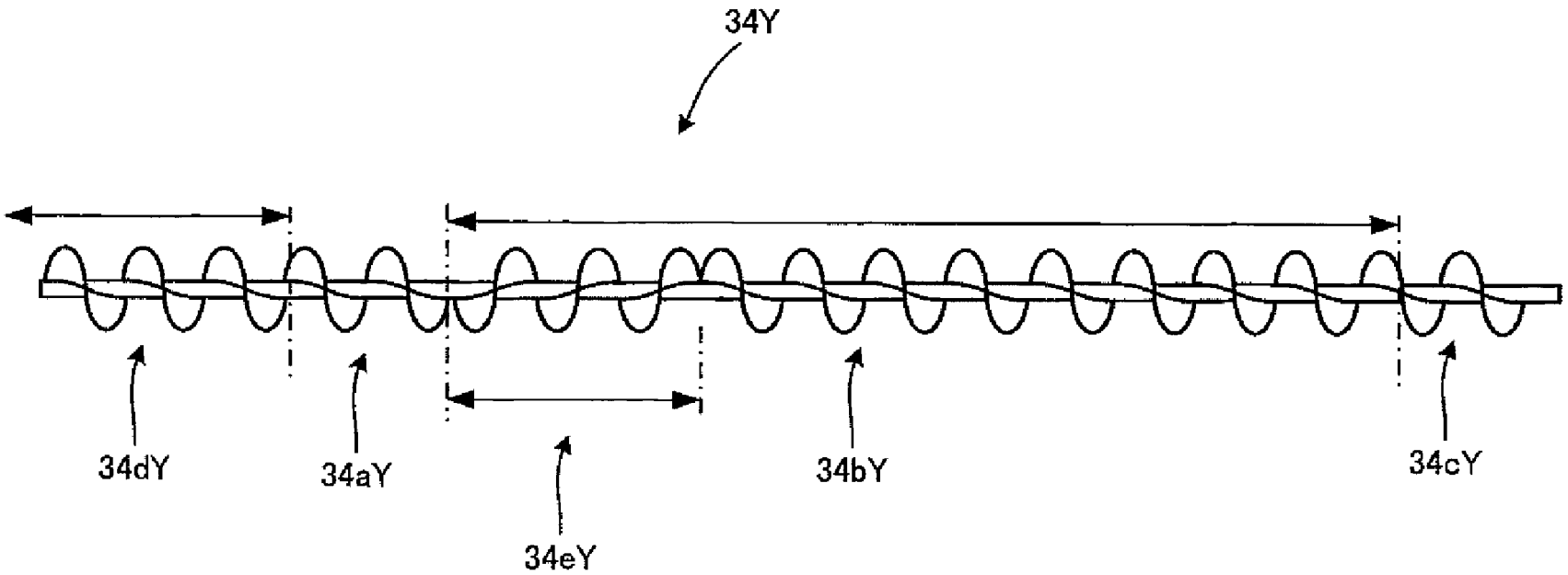
FIG. 9 is a drawing showing the collecting auger.

FIG. 9 shows still another embodiment. The collecting auger 34Y shown in FIG. 9 has a reversely conveying pitch section 34$e$Y as a reversely conveying portion in the reverse direction in part of the second conveying pitch section 34$b$Y, and hence a large shearing force is applied to the developer which is collected by the developing roller cleaning blade 21Y and coagulated once, so that the stirring property and the dispersing property are improved.

Subsequently, a control of liquid developer conveying velocity will be described. In this embodiment, the number of revolutions of the developer collecting unit motor 39$c$Y as a velocity changing unit is controlled on the basis of image data, and hence revolving velocity of the collecting auger 34Y and the liquid developer conveying velocity are controlled.

Figure 10:
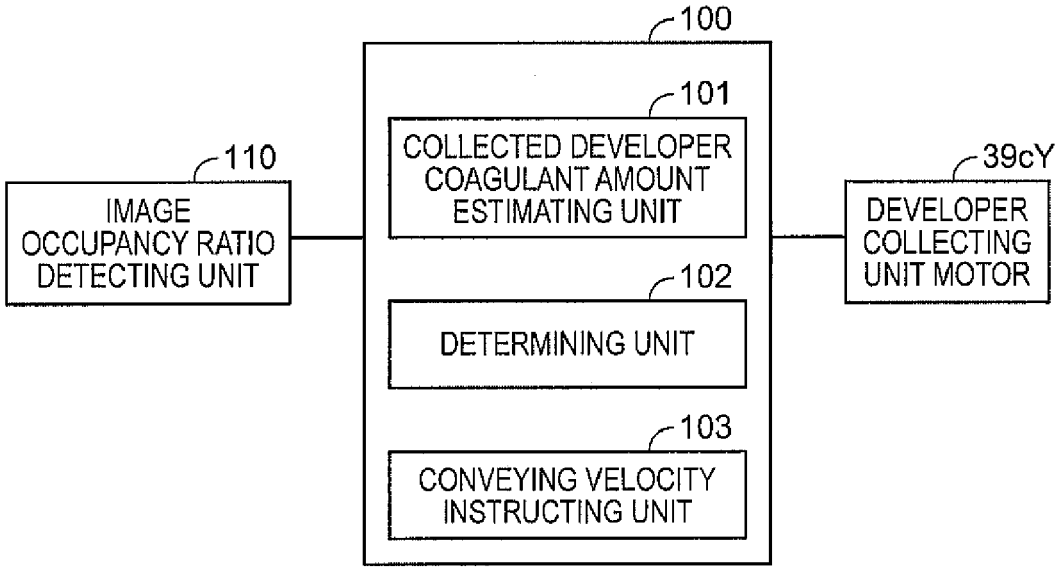
FIG. 10 is a block diagram of a liquid developer conveying velocity controlling device.

FIG. 10 is a block diagram showing a conveying velocity control device 100 for the liquid developer. The conveying velocity control device 100 includes a liquid developer coagulant amount estimating unit 101 as a liquid developer state determining unit, a determining unit 102 as a liquid developer state determining unit, and a conveying velocity instructing unit 103, processes input signals from an image occupancy ratio detecting unit 110, and controls the number of revolutions of the developer collecting unit motor 39$c$Y to control the revolving velocity of the collecting auger 34Y.

In this embodiment, an image occupancy ratio is used as the image data. The image occupancy ratio is the number of dots to be printed for the total number of dots included in one transfer material, for example, one page (the total number of dots to be printed and dots not to be printed), and is detected by calculating the image data or the like by the image occupancy ratio detecting unit 110.

Figure 11:
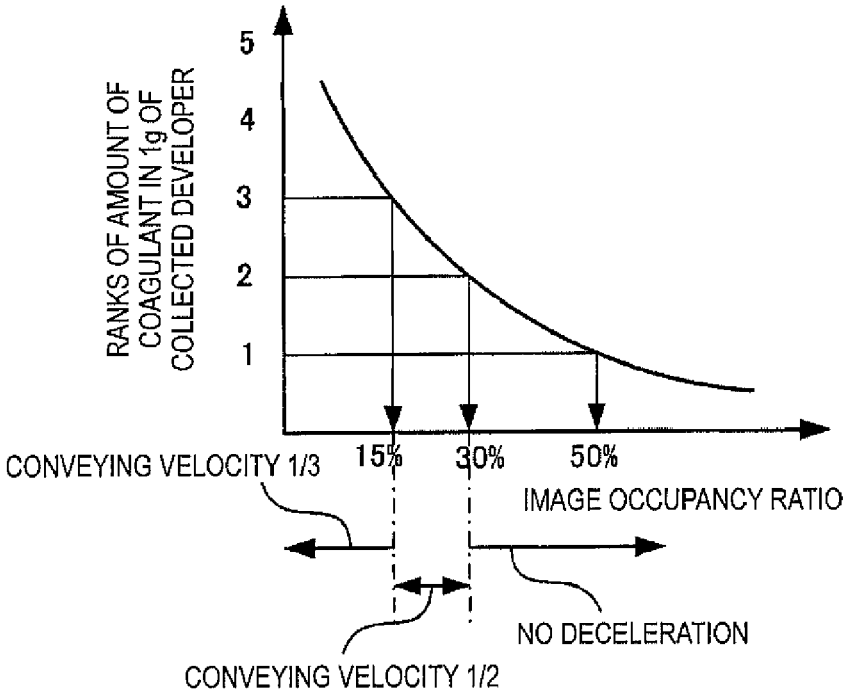
FIG. 11 is a graph showing a relation between an image occupancy ratio and the amount of coagulant in liquid developer collected by a developing roller cleaning blade.

The collected developer coagulant amount estimating unit 101 is that estimates the amount of the coagulant in the liquid developer collected by the developing roller cleaning blade 21Y from the image occupancy ratio detected by the image occupancy ratio detecting unit 110 on the basis of an estimating table as shown in FIG. 11.

The liquid developer collected by the developing roller cleaning blade 21Y is coagulant of the toner particles of the developer which corresponds to the non-image portion. The degree of coagulation is evaluated by extracting large particles by repeating steps of diluting the developer after development, settling down large particles and removing supernatant fluid by a plurality of times, and classifying the particles into ranks as shown below. The term "large particles" indicates particles having a diameter of 10 μm or larger which is far bigger than particles in the range of average diameters from 2 to 4 μm.

The determining unit 102 classifies the amount of coagulant existing in 1 g of liquid developer which is left undeveloped by the developing roller 20Y and collected by the cleaning blade into ranks.

Rank 0: no coagulant
Rank 1: 1 to 3 coagulants
Rank 2: 3 to 30 coagulants
Rank 3: 30 to 100 coagulants
Rank 4: more than 100 coagulants, uncountable
Rank 5: exceed Rank 4 and uniformly coagulated The conveying velocity instructing unit 103 determines the revolving velocity of the collecting auger 34Y according to the rank of the amount of the coagulant in the liquid developer collected by the developing roller cleaning blade 21Y, which is estimated by the collected developer coagulant amount estimating unit 101.

Figure 12:
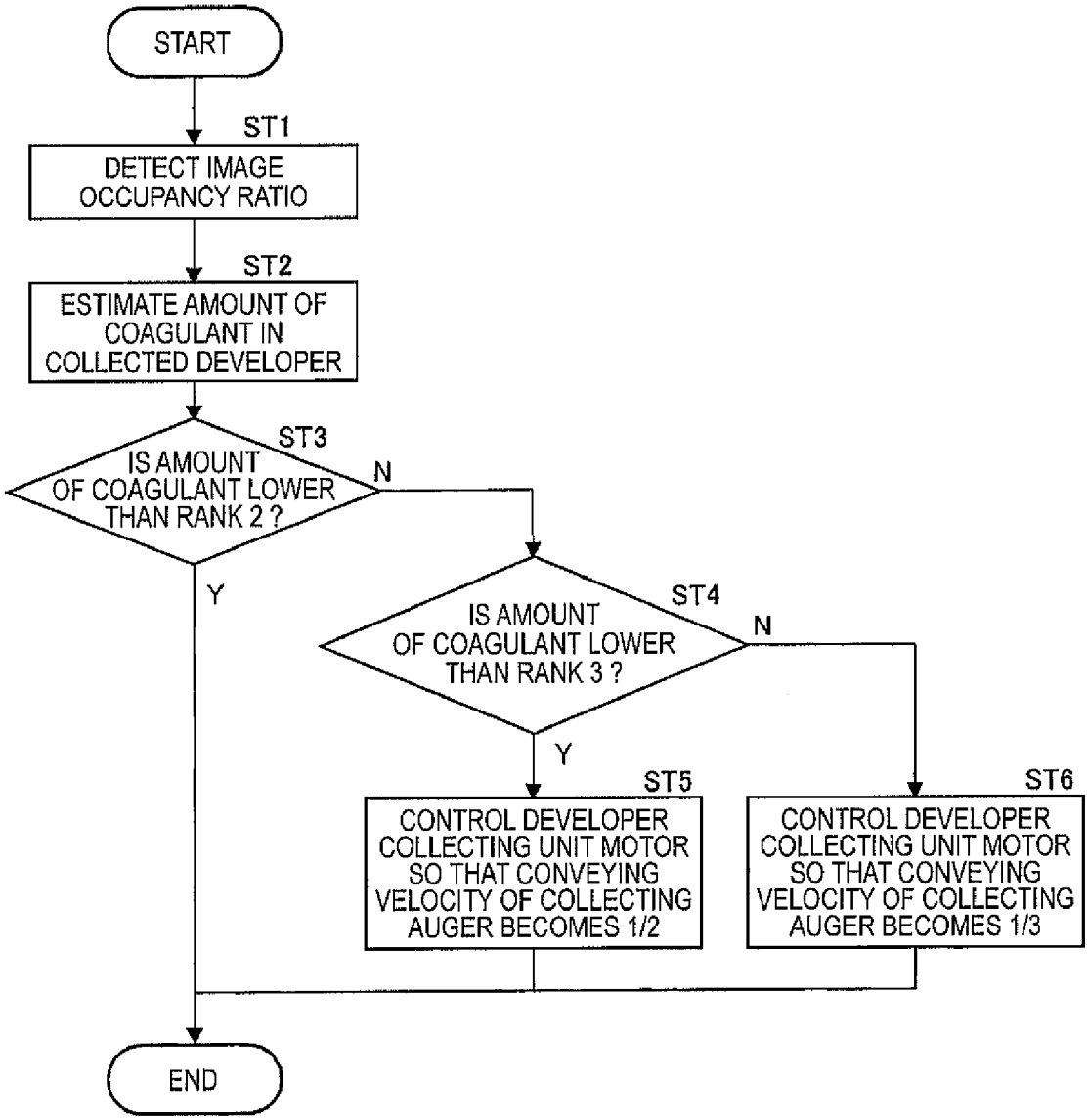
FIG. 12 is a flowchart of a liquid developer conveying velocity control by a conveying velocity controlling device according to a first embodiment.

FIG. 12 is a flowchart of a liquid developer conveying velocity control by the conveying velocity controlling device 100 according to a first embodiment. In the first embodiment, the control includes detecting the image occupancy ratio, determining the state of coagulation of the solid in the liquid developer collected into the collecting unit 31$b$Y in the developer container 31Y by the developing roller cleaning blade 21Y according to the detected result of the image occupancy ratio, and controlling the conveying velocity of the collecting auger 34Y which conveys the liquid developer in the collecting unit 31$b$Y according to the determined state of coagulation. Detailed description will be given below.

In Step 1, the image occupancy ratio is detected by the image occupancy ratio detecting unit 110 (ST1). Subsequently, in Step 2, the amount of coagulant in the liquid developer collected by the developing roller cleaning blade 21Y is estimated by the collected developer coagulant amount estimating unit 101 (ST2).

Subsequently, in Step 3, the determining unit 102 determines whether the estimated amount of coagulant in the liquid developer is lower than Rank 2 or not (ST3). If the amount of coagulant in the liquid developer is lower than Rank 2 in Step 3, the transfer velocity instructing unit 103 ends the conveying velocity control without changing the revolving velocity of the collecting auger 34Y. If it is not lower than Rank 2 in Step 3, the determining unit 102 determines whether the estimated amount of coagulant in the liquid developer is lower than Rank 3 or not in Step 4 (ST4).

If the estimated amount of coagulant in the liquid developer is lower than the Rank 3 in Step 4, the conveying velocity instructing unit 103 gives an instruction to the developer collecting unit motor 39$c$Y to reduce the revolving velocity of the collecting auger 34Y to ½ in Step 5 (ST5), and ends the conveying velocity control. If the estimated amount of coagulant in the liquid developer is not lower than the Rank 3, that is, it is Rank 4 or 5 in Step 4, the conveying velocity instructing unit 103 gives an instruction to the developer collecting unit motor 39$c$Y to reduce the revolving velocity of the collecting auger 34Y to ⅓ in Step 6 (ST6), and ends the conveying velocity control.

Figure 13:
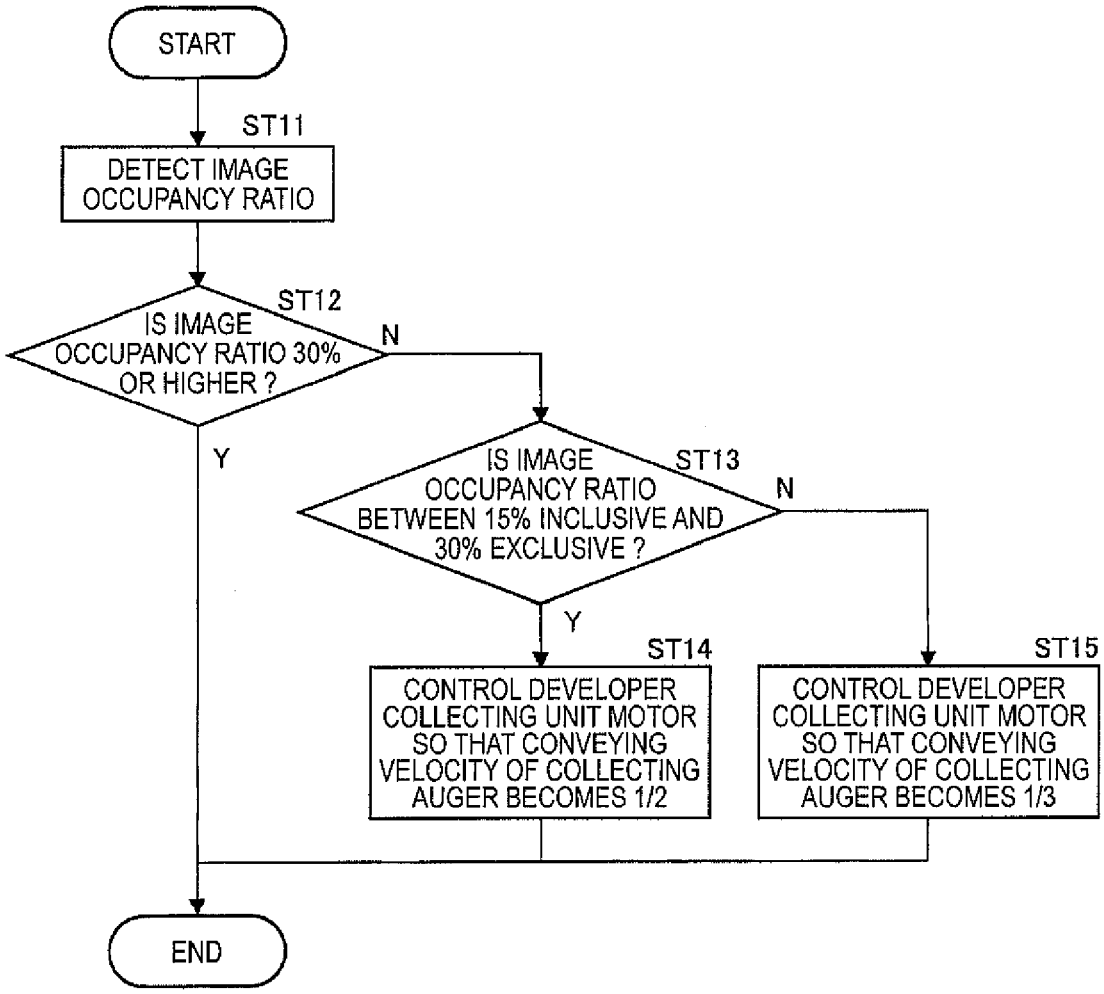
FIG. 13 is a flowchart of the liquid developer conveying velocity control by the conveying velocity controlling device according to a second embodiment.

FIG. 13 is a flowchart of the liquid developer conveying velocity control by the conveying velocity controlling device 100 according to a second embodiment. In the second embodiment, the control includes a step of detecting the image occupancy ratio, a step of estimating and determining the state of coagulation of the solid in the liquid developer collected into the collecting unit 31$b$Y in the developer container 31Y by the developing roller cleaning blade 21Y according to the result of detection from the image occupancy ratio in advance, and a step of controlling the conveying velocity of the collecting auger 34Y which conveys the liquid developer in the collecting unit 31$b$Y according to the result of detection from the image occupancy ratio corresponding to the determined state of coagulation.

In Step 11, the image occupancy ratio is detected by the image occupancy ratio detecting unit 110 (ST11). Subsequently, in Step 12, the determining unit 102 determines whether the image occupancy ratio is 30% or higher or not (ST12). If the image occupancy ratio is 30% or higher in Step 12, the conveying velocity control is ended without changing the revolving velocity of the collecting auger 34Y. In Step 12, if the image occupancy ratio is not 30% or higher, the determining unit 102 determines whether the image occupancy ratio is between 15% inclusive and 30% exclusive in Step 13 (ST13).

If the image occupancy ratio is between 15% inclusive and 30% exclusive in Step 13, the conveying velocity instructing unit 103 gives an instruction to the developer collecting unit motor 39$c$Y to reduce the revolving velocity of the collecting auger 34Y to ½ in Step 14 (ST14), and ends the conveying velocity control. If the image occupancy ratio is not between 15% inclusive and 30% exclusive, that is, when the image occupancy ratio is lower than 15% in Step 13, the conveying velocity instructing unit 103 gives an instruction to the developer collecting unit motor 39$c$Y to reduce the revolving velocity of the collecting auger 34Y to ⅓ in Step 15 (ST15), and ends the conveying velocity control.

In this manner, the image forming apparatus in this embodiment includes the developing roller 20Y that carries the liquid developer, the latent image carrier 10Y on which a latent image is developed by the developing roller 20Y, the charger 11Y that charges the latent image carrier 10Y, the exposing unit 12Y that exposes the latent image carrier 10Y, a transfer member 40 that transfers an image on the latent image carrier 10Y, the developer feeding roller 32Y that feeds the liquid developer to the developing roller 20Y, the developing roller cleaning blade 21Y that collects the liquid developer on the developing roller 20Y, the collecting unit 31$b$Y that collects the liquid developer collected by the developing roller cleaning blade 21Y, the feeding unit 31$a$Y that allows the liquid developer to flow to the collecting unit 31$b$Y, the collecting auger 34Y that conveys the liquid developer collected by the collecting unit 31$b$Y in the first direction X, the developer collecting unit motor 39$c$Y that changes the conveying velocity of the collecting auger 34Y, the image occupancy ratio detecting unit 110 that detects image data, the collected developer coagulant amount estimating units 101, 102 that determine the state of the liquid developer collected by the developing roller cleaning blade 21Y on the basis of the result of detection from the image occupancy ratio detecting unit 110, and the conveying velocity instructing unit 103 that gives an instruction to the developer collecting unit motor 39$c$Y to change the conveying velocity of the collecting auger 34Y on the basis of the result of determination by the collected developer coagulant amount estimating units 101, 102, so that the stirring property and the dispersing property of the liquid developer in the developer container 31Y are improved without necessity to add a new member or change the configuration significantly.

The collected developer coagulant amount estimating units 101, 102 estimate the coagulating state of the solid in the liquid developer collected by the developing roller cleaning blade 21Y on the basis of the result of detection from the image occupancy ratio detecting unit 110 in advance, and the conveying velocity instructing unit 103 gives an instruction to the developer collecting unit motor 39$c$Y to change the conveying velocity of the collecting auger 34Y according to the result of detection from the image occupancy ratio detecting unit 110 in advance corresponding to the coagulating state determined by the collected developer coagulant amount estimating units 101, 102. Therefore, alleviation of the load of calculation is achieved.

Also, since the image occupancy ratio detecting unit 110 detects the image occupancy ratio obtained by finding the number of dots to be printed with respect to the total number of dots included in one transfer material, an apparatus which provides a further better image quality can be provided at a low cost.

Also, the developing unit collecting channel 72Y that collects the liquid developer on one end side of the collecting auger 34Y, and the liquid level adjusting panel 37Y between the feeding unit 31$a$Y and the collecting unit 31$b$Y, are provided, and the liquid level adjusting panel 37Y includes the first wall height portion 37$a$Y, the second wall height portion 37$b$Y to be disposed on the side of the first direction X with respect to the first wall height portion 37$a$Y, a third wall height portion 37$c$Y disposed on the opposite side from the first direction X with respect to the first wall height portion 37$a$Y and the second wall height portion 37$b$Y, the first fluidizing portion 38$a$Y arranged on the second wall height portion 37$b$Y in the second direction Y which is orthogonal or substantially orthogonal to the first direction X with respect to the collecting auger 34Y and allowing the liquid developer to flow from the feeding unit 31$a$Y, and the second fluidizing portion 38$b$Y arranged on the third wall height portion 37$c$Y in the second direction Y which is orthogonal or substantially orthogonal to the first direction X with respect to the collecting auger 34Y to allow the liquid developer to flow from the feeding unit 31$a$Y. Therefore, liquid leakage from the developer container 31Y is reduced.

Since the collecting auger 34Y has the helical blade, liquid leakage from the developer container 31Y is reduced.

The collecting auger 34Y includes the conveying sections that convey the liquid developer in the first direction, and the retaining section that retains the liquid developer temporarily or the reversely conveying section that conveys the liquid developer in the opposite direction from the first direction. Therefore, the stirring property and the dispersing property of the liquid developer are further improved.

Subsequently, the second embodiment will be described further in detail.

The image forming apparatus in the second embodiment is also able to adjust the stirring amount by the collecting auger 34Y by the developer collecting unit motor 39$c$Y as a stirring amount adjusting unit. Here, the stirring amount means the amount stirred by the collecting unit 31$b$Y, that is, the amount stirred in the conveyed state. Therefore, the stirring time is increased by changing the conveying time, the conveying velocity, the conveying direction or the like, so that adjustment of the stirring amount is achieved.

By increasing the conveying time in the collecting unit 31$b$Y, the coagulation among the particles is weakened by a three-dimensional repulsive force generated by an electrostatic force among the toner particles. Then stirring as liquid occurs. Therefore, the adjustment of the stirring amount is achieved also by changing the conveying force. Table 1 shows a relation between among the conveying velocity, the conveying time, and the stirring performance.

TABLE 1

| | Conveying Velocity | | |
|---|---|---|---|
| | Normal | ½ velocity | ⅓ velocity |
| Conveying Time | 1 | 2 | 3 |
| Stirring Performance | Normal | Good | Better |

For example, as regards the examples of the collecting auger 34Y shown in FIG. 7 to FIG. 9, improvement of the stirring amount is possible. In the examples shown in FIG. 7 and FIG. 8, the flow of the liquid developer in the direction of conveyance as the first direction is blocked by adding the paddles in the flow generated in the collecting auger 34Y, and the stirring force is generated by the paddles by adding a movement different from the flow. In the example shown in FIG. 9, improvement of the stirring performance is achieved by generating a flow in the opposite direction in the reversely conveying pitch section 34$e$Y.

Figure 14:
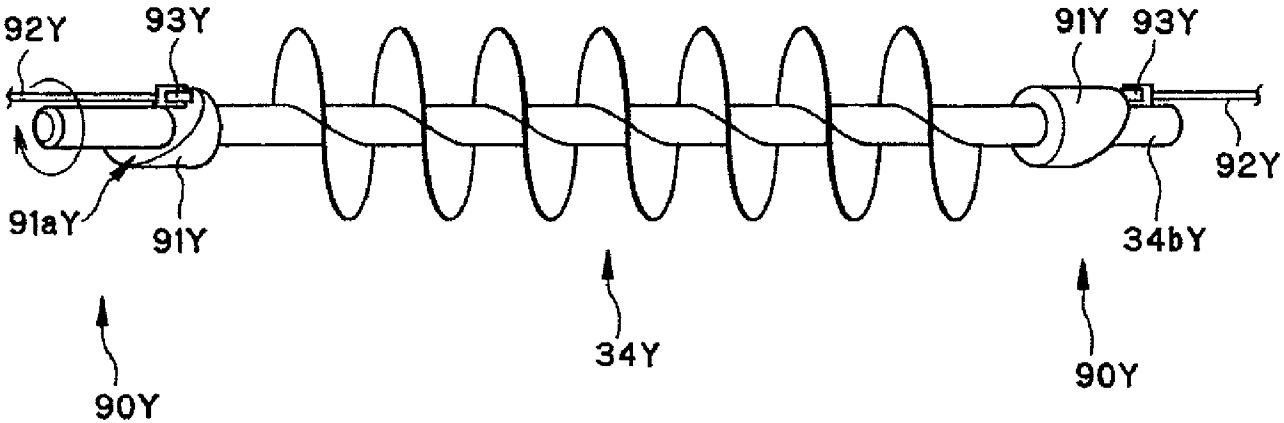
FIG. 14 is a drawing showing a collecting auger 34Y according to another embodiment.
Figure 17:
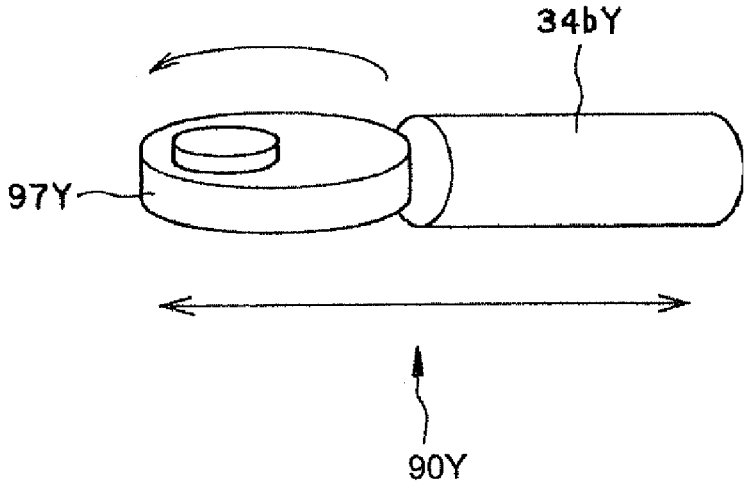
FIG. 17 is a drawing showing the collecting auger 34Y according to another embodiment.

Subsequently, other embodiments of the collecting auger 34Y will be described. FIG. 14 and FIG. 17 are drawings showing the collecting auger 34Y according to other embodiments. The collecting auger 34Y in these embodiments includes a swinging mechanism 90Y.

Figure 15:
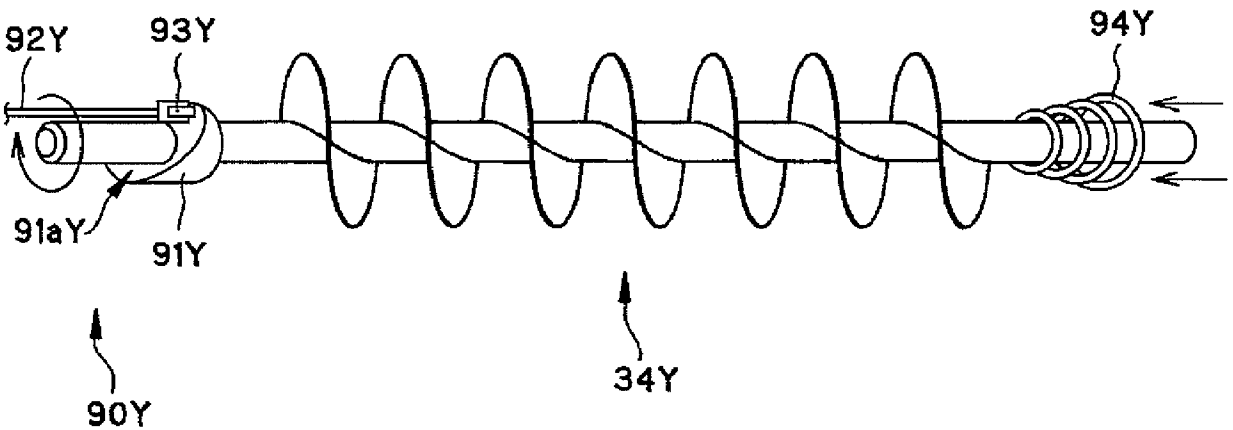
FIG. 15 is a drawing showing the collecting auger 34Y according to another embodiment.

In the embodiments shown in FIG. 14 and FIG. 15, cam members 91Y are arranged at the ends of the collecting auger 34Y, and the collecting auger 34Y by itself is swung while setting the conveying direction to one direction, so that the stirring is carried out. Also, by changing the number of revolutions of the collecting auger 34Y, the swinging time is also changed, so that improvement of the stirring force is achieved. Rollers 93Y are brought into abutment with the cam members 91Y and brought into a swinging movement. The driving of the collecting auger 34Y is connected to a collecting auger shaft 34$b$Y by a drive transmitting device, not shown. An urging member such as a spring may be provided at one side.

The swinging mechanisms 90Y shown in FIG. 14 each include the cam members 91Y having an inclined surface 91$a$Y fixed to the collecting auger shaft 34$b$Y of the collecting auger 34Y, and are configured to bring the rollers 93Y urged by a roller urging unit 92Y into abutment with the inclined surface 91$a$Y. The swinging mechanisms 90Y are provided at both ends of the collecting auger shaft 34$b$Y in an opposite phase. In this configuration, when the collecting auger shaft 34*b*Y is rotated, the inclined surfaces 91*a*Y are pressed by the rollers 93Y and the collecting auger 34Y is swung in the axial direction.

The swinging mechanism 90Y shown in FIG. 15 is provided at one end of the collecting auger shaft 34*b*Y, and the other end thereof is pressed by the spring 94Y. In this configuration, when the collecting auger shaft 34*b*Y is rotated, the inclined surfaces 91*a*Y are pressed by the rollers 93Y and the collecting auger 34Y is swung in the axial direction.

Figure 16:
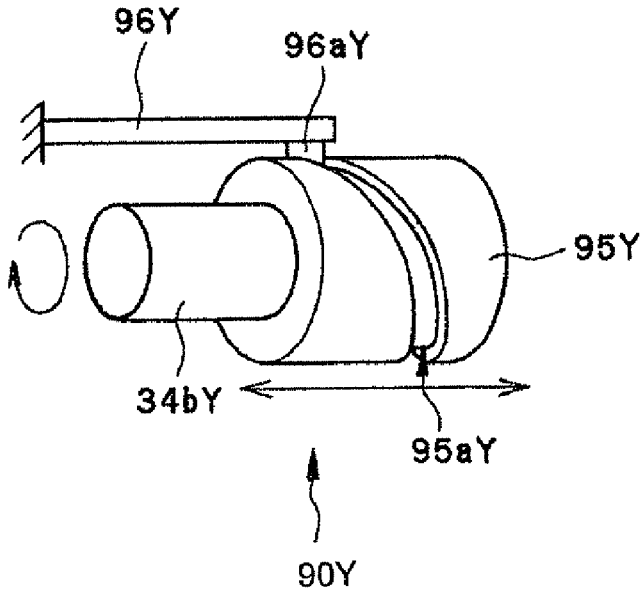
FIG. 16 is a drawing showing the collecting auger 34Y according to another embodiment.

The swinging mechanism 90Y shown in FIG. 16 includes a groove member 95Y with a groove formed thereon arranged on the collecting auger shaft 34*b*Y, and generates an axial movement by bringing a projection 96*a*Y into abutment with a groove 95*a*Y formed on the groove member 95Y. Specifically, the groove member 95Y having the groove 95*a*Y near the end of the collecting auger shaft 34*b*Y of the collecting auger 34Y and a supporting member 96Y having a projection 96*a*Y which enters a groove 94*a*Y and fixing the projection 96*a*Y to the housing or the like are provided. In this configuration, when the collecting auger shaft 34*b*Y is rotated, the projection 96*a*Y slides in the groove 95*a*Y, and the collecting auger 34Y is swung in the axial direction.

The swinging mechanism 90Y shown in FIG. 17 is configured to bring one end portion of the collecting auger shaft 34*b*Y of the collecting auger 34Y into abutment with the upper surface of the eccentric cam 97Y, and swing the collecting auger shaft 34*b*Y by the rotation of the eccentric cam 97Y. The other end of the collecting auger shaft 34*b*Y is pressed by a shaft urging member such as a spring, and is always brought into abutment with the eccentric cam 97Y. A motive power is transmitted to the collecting auger shaft 34*b*Y from the direction orthogonal to the shaft by a gear or the like.

In this configuration, the collecting auger 34Y is swung by the rotation of the eccentric cam 97Y. Since the revolving velocity of the eccentric cam 97Y is changeable, not the revolving velocity of the collecting auger 34Y, swinging is enabled irrespective of the conveying velocity.

Although changing the stirring force by changing the conveying velocity has been described thus far, a method which demonstrates the same effect as providing the swinging force by rotating the developer collecting unit motor 39*c*Y in the reverse direction and rotating the collecting auger 34Y in the reverse direction is also applicable.

The developer collecting unit motor 39*c*Y normally drives in the normal direction which allows the liquid developer to flow in the fixed collecting direction in the collecting unit 31*b*Y, and swinging movement of the liquid developer in the collecting unit 31*b*Y is achieved by providing a reverse rotation, whereby further improved stirring is achieved. For example, in the embodiments shown in FIG. 14 to FIG. 16, the same effect is achieved by reducing the time of reverse rotation to 30% of a certain time for reducing the conveying velocity to ½, and by reducing the time of the reverse rotation to 20% of the certain time for reducing the conveying velocity to ⅓.

Figure 18:
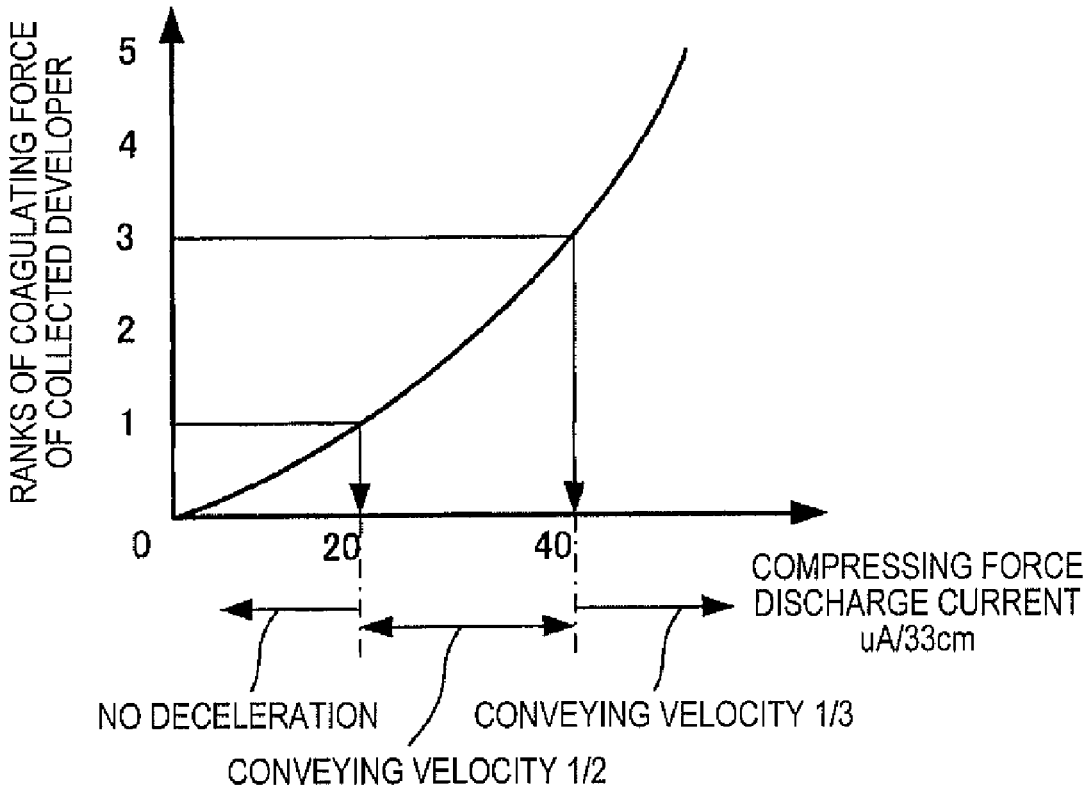
FIG. 18 is a graph showing a coagulating force of the liquid developer against a compressing force.
Figure 19:
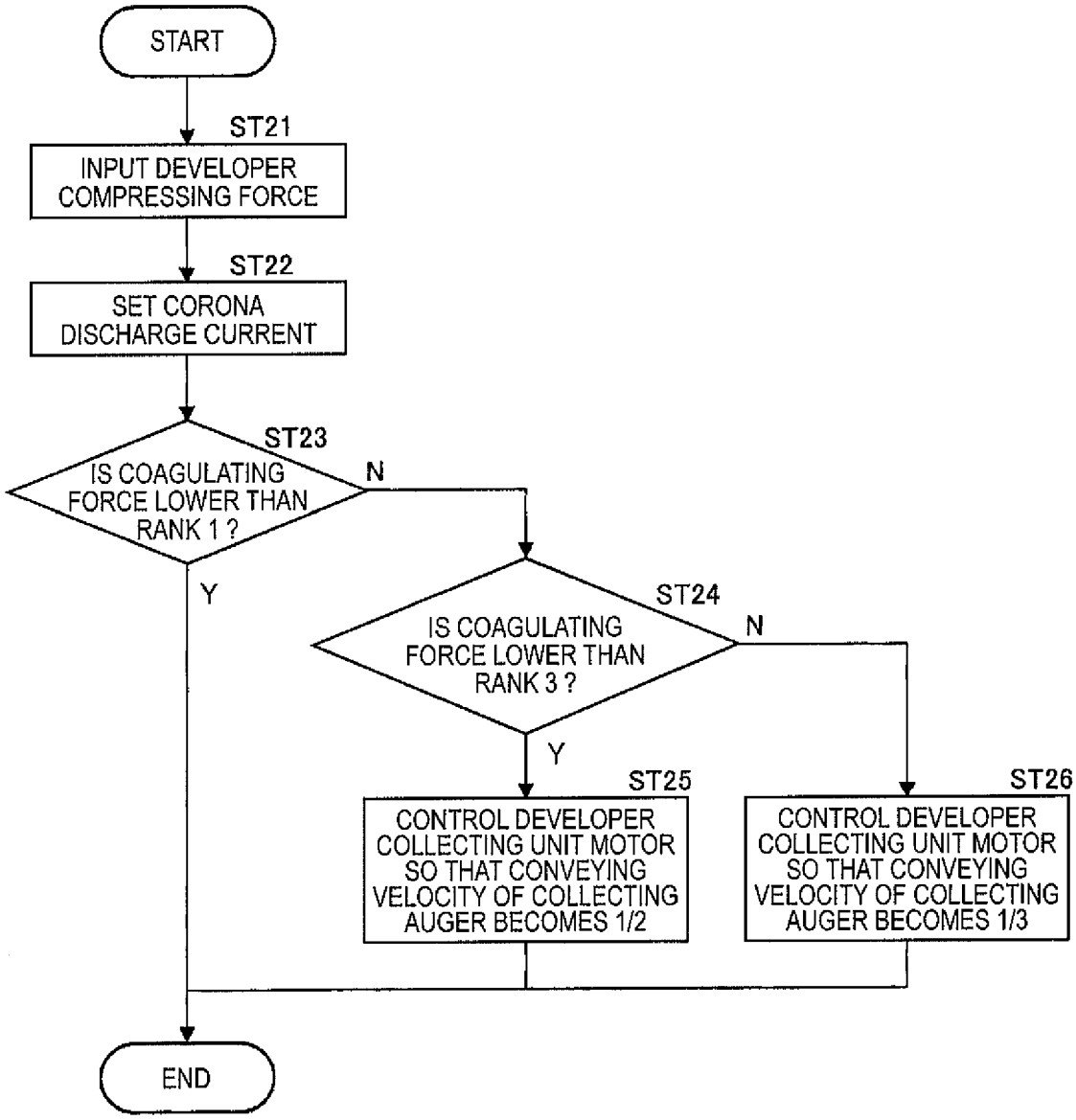
FIG. 19 is a flowchart of the liquid developer conveying velocity control by the conveying velocity controlling device according to a third embodiment.

Subsequently, an embodiment for adjusting the stirring amount by the developer compressing device 22Y as a bias applying unit will be described. FIG. 18 is a graph showing the rank of the coagulating force of the liquid developer in the collecting unit with respect to the compressing force discharge current, and FIG. 19 is a flowchart of the liquid developer conveying velocity control by the conveying velocity controlling device according to a third embodiment.

The coagulated state of the coagulated toner is deteriorated also in developer compressing device 22Y. The compressed state varies because of the features of the developer. The coagulating characteristics of the developer is inputted by an operator and the standard velocity is renewed at a controller of a main body or the like or, alternatively, the coagulating characteristics after the development are transferred to the controller of the main body or the like from an IC memory attached to a replaced developer container 31Y to renew the standard velocity at the controller of the main body or the like. The term "standard velocity" indicates a reference velocity of the conveying velocity to be increased or decreased.

In order to improve the developing performance by monitoring the state of development, the toner particles are compressed using the developer compressing device 22Y, in this case, a corona charger. At this time, the toner which received the compressing force is coagulated, and the toner which is not developed on the latent image carrier 10Y is collected by the developing roller cleaning blade 21Y.

FIG. 18 is the graph showing the coagulating force of the liquid developer with respect to the compressing force applied thereto. The coagulating force is to be strong in Rank 5 and weak in Rank 0. As a method of changing the compressing force, it can be controlled by the current amount discharged to the developing roller 20Y of the developer compressing device 22Y. No deceleration is necessary when the compressing force discharge current is 20 uA/33 cm or lower, and the conveying velocity is set to ½ when it falls a range between 20 uA/33 cm exclusive and 40 uA/33 cm inclusive, and then to ⅓ when it exceeds 40 uA/33 cm.

FIG. 19 is a flowchart of the control of the liquid developer conveying velocity by the conveying velocity control device 100 according to the third embodiment. In the third embodiment, the control includes a step of inputting the developer compressing force, a step of determining the state of coagulation of the solid in the liquid developer collected into the collecting unit 31*b*Y in the developer container 31Y by the developing roller cleaning blade 21Y on the basis of the detected result of the coagulating force, and a step of controlling the conveying velocity of the collecting auger 34Y which conveys the liquid developer in the collecting unit 31*b*Y according to the determined state of coagulation. Detailed description will be given below.

In Step 21, the developer compressing force is entered (ST21). Subsequently, the discharge current of the developer compressing device 22Y is set in Step 22 (ST22).

Subsequently, in Step 23, the determining unit 102 determines whether the estimated coagulating force of the liquid developer is lower than Rank 1 or not (ST23). If the coagulating force in the liquid developer is lower than Rank 1 in Step 23, the conveying velocity indicating unit 103 does not change the revolving velocity of the collecting auger 34Y and ends the conveying velocity control. If it is not lower than Rank 1 in Step 23, the determining unit 102 determines whether the estimated coagulating force in the liquid developer is lower than Rank 3 or not in Step 24 (ST24).

If the estimated amount of coagulant in the liquid developer is lower than Rank 3 in Step 24, the conveying velocity indicating unit 103 gives an instruction to the developer collecting unit motor 39*c*Y to reduce the revolving velocity of the collecting auger 34Y to ½ in Step 25 (ST25), and ends the conveying velocity control. If the estimated amount of coagulant in the liquid developer is not lower than Rank 3, that is, it is Rank 4 or 5 in Step 24, the conveying velocity indicating unit 103 gives an instruction to the developer collecting unit motor 39*c*Y to reduce the revolving velocity of the collecting auger 34Y to ⅓ in Step 26 (ST26), and ends the conveying velocity control.

The stirring amount adjusting member according to the embodiment in the invention includes the developer collecting unit motor 39$c$Y in the embodiments, and the bias applying member includes the developer compressing device 22Y. The collected developer storing portion includes the collecting unit 31$b$Y. Also, the liquid developer state determining unit includes the collected developer coagulant amount estimating unit 101, and the image data detecting unit includes the image occupancy ratio detecting unit 110. The image data detecting unit may be the one which detects the discharge current of the developer compressing device 22Y or the one which is able to detect the compressed state of the liquid developer carried by the developing roller 20Y.

According to the image forming apparatus in the embodiments, improvement of the stirring property and the dispersing property of the liquid developer in the developer container without adding a new member or changing the configuration significantly is achieved. Also, alleviation of the calculation load is achieved.

The entire disclosure of Japanese Patent Application Nos: 2008-80317, filed Mar. 26, 2008 and 2008-320711, filed Dec. 17, 2008 are expressly incorporated by reference herein.

What is claimed is:

1. An image forming apparatus comprises:

a latent image carrier on which a latent image is formed;

a charging unit that charges the latent image carrier;

an exposing unit that exposes the latent image carrier charged by the charging unit and forms the latent image;

a developing unit including a developer carrier that carries liquid developer containing toner and carrier liquid, a developer feeding member that feeds the liquid developer to the developer carrier, a bias applying member that applies a bias to the liquid developer on the developer carrier, a developer carrier cleaning member that collects the liquid developer on the developer carrier, a collected developer storing portion that stores the collected liquid developer collected by the developer carrier cleaning member, wherein the collected liquid developer is conveyed to a liquid developer storing unit, a feeding unit that feeds the liquid developer to the collected developer storing portion and the developer feeding member, a conveying member that stirs the collected liquid developer collected by the collected developer storing portion, and a stirring amount adjusting member that adjusts a stirring amount of the conveying member to improve a property of the collected liquid developer conveyed to the liquid developer storing unit; and a transfer member that transfers an image on the latent image carrier.

2. The image forming apparatus according to claim 1, further comprising a liquid developer state determining unit that determines a state of the liquid developer stored in the collected developer storing portion.

3. The image forming apparatus according to claim 2, further comprising an image data detecting unit that detects image data.

4. The image forming apparatus according to claim 3, wherein the image data detecting unit calculates an image occupancy ratio based on a number of dots to be printed on one transfer material.

5. The image forming apparatus according to claim 3, wherein the image data detecting unit detects a charged state of the liquid developer carried by the developer carrier.

6. The image forming apparatus according to claim 5, wherein the image data detecting unit detects a discharge current from the bias applying member.

7. The image forming apparatus according to claim 3, wherein the liquid developer state determining unit estimates a coagulating state of toner in the liquid developer in the collected developer storing portion based on a result of detection from the image data detecting unit.

8. The image forming apparatus according to claim 1, wherein the conveying member is an auger that has a helical blade.

9. The image forming apparatus according to claim 1, wherein the conveying member includes a conveying section that conveys the liquid developer in a first direction, and a retaining section that retains the liquid developer or a reversely conveying section that conveys the liquid developer in a direction opposite from the first direction.

10. The image forming apparatus according to claim 1, wherein the conveying member swings in a first direction that is a direction of conveyance of the liquid developer and a direction opposite from the first direction.

11. The image forming apparatus according to claim 7, wherein the stirring amount adjusting member changes a revolving velocity of the conveying member according to the coagulated state of the toner in the liquid developer estimated by the liquid developer state determining unit.

12. The image forming apparatus according to claim 2, wherein the stirring amount adjusting member changes a revolving direction of the conveying member according to the coagulated state of the toner in the liquid developer estimated by the liquid developer state determining unit.

13. A developing method comprising:

detecting a state of bias application of liquid developer carried by a developer carrier;

determining a state of the liquid developer in a collected developer storing portion in a developer container from the state of bias application; and controlling a stirring amount of a conveying member based on a result of determination to improve a property of the collected liquid developer conveyed to the liquid developer storing unit.

14. An image forming method comprising:

developing a latent image exposed on a latent image carrier by an exposing unit on a developer carrier;

detecting image data when carrying out image formation by transferring the developed image to a transferring member;

determining a state of liquid developer in a collected developer storing portion in a developer container based on a result of detection from the image data; and controlling a stirring amount of a conveying member based on the result of determination to improve a property of the collected liquid developer conveyed to the liquid developer storing unit.

15. The image forming method according to claim 14, further comprising estimating the state of the liquid developer in the collected developer storing portion corresponding to the image data.

* * * * *